US008303269B2

(12) United States Patent
Metzger et al.

(10) Patent No.: US 8,303,269 B2
(45) Date of Patent: Nov. 6, 2012

(54) VACUUM PUMP WITH A MULTI-SECTIONAL HOUSING

(75) Inventors: Juergen Metzger, Giessen (DE); Juergen Wagner, Mueschenbach (DE); Stefan Saenger, Herborn (DE)

(73) Assignee: Pfeiffer Vaccum GmbH, Asslar (DE)

( * ) Notice: Subject to any disclaimer, the term of this patent is extended or adjusted under 35 U.S.C. 154(b) by 474 days.

(21) Appl. No.: 12/001,909

(22) Filed: Dec. 12, 2007

(65) Prior Publication Data

US 2008/0145214 A1 Jun. 19, 2008

(30) Foreign Application Priority Data

Dec. 13, 2006 (DE) ..... 10 2006 058 843

(51) Int. Cl.
*F04B 39/02* (2006.01)
*F04B 39/06* (2006.01)

(52) U.S. Cl. ..... 417/368; 417/366

(58) Field of Classification Search ..... 417/281, 417/410.3, 366, 368; 310/53, 59, 63–64; 418/83, 85, 99, 255

See application file for complete search history.

(56) References Cited

U.S. PATENT DOCUMENTS

| | | | | |
|---|---|---|---|---|
| 3,001,121 | A * | 9/1961 | Kerr, Jr. | 363/145 |
| 3,356,873 | A * | 12/1967 | Tamm | 310/68 R |
| 3,638,594 | A * | 2/1972 | Armstead et al. | 112/280 |
| 3,748,509 | A * | 7/1973 | Karcher | 310/68 D |
| 4,268,230 | A * | 5/1981 | Bassan | 418/15 |
| 4,480,967 | A * | 11/1984 | Schulze | 417/368 |
| 4,797,071 | A * | 1/1989 | Veyrat | 417/410.3 |
| 5,145,335 | A * | 9/1992 | Abelen et al. | 417/410.3 |
| 6,784,574 | B2 * | 8/2004 | Turner et al. | 310/58 |
| 2005/0260082 | A1 * | 11/2005 | Conrad et al. | 417/410.3 |

* cited by examiner

*Primary Examiner* — Devon Kramer
*Assistant Examiner* — Peter J Bertheaud
(74) *Attorney, Agent, or Firm* — Abelman, Frayne & Schwab

(57) ABSTRACT

A vacuum pump for producing low or high vacuum has a housing having a gas inlet and a gas outlet, a pumping system located in the housing, a motor for driving the pumping system, and a control electronics for controlling operation of the pump and likewise located in the housing, with the pumping system and the control electronics being located in separate housing sections of the housing.

8 Claims, 5 Drawing Sheets

VACUUM PUMP WITH A MULTI-SECTIONAL HOUSING

BACKGROUND OF THE INVENTION

1. Field of the Invention

The present invention relates to a vacuum pump for producing low or high vacuum and including a housing having a gas inlet and a gas outlet, a pumping system located in the housing, a motor for driving the pumping system, and a control electronics for controlling operation of the pump and likewise located in the housing.

2. Description of the Prior Art

A design of vacuum pumps for producing low and high vacuum, which is conventional in state of the art, is described in European Publication EP-A 1 591 663 with reference to an oil-tight vane rotary vacuum pump. The pump, which is described in the European Publication has an asynchronous motor with a fan and control electronics located in a box secured to the motor. These components form together the pump drive and are flanged on the pump housing. The components, which are necessary for producing the vacuum, are located in the pump housing. In case of a vane rotary vacuum pump, the pumping system includes shaft, rotor, stator, and vane or vanes and is surrounded by an oil bath located in the pump housing. A large amount of heat is generated in the housing of a vacuum pump. The cooling is effected only by the fan, which is supported on the motor shaft and is located at an end of the vacuum pump remote from the pumping system. The drawback of this arrangement consists that it makes for a complicated heat balance.

Another drawback of this concept becomes apparent when the entire line of the vacuum pumps is considered. The line includes many models that differs from each other by their suction capacity and their end pressure. As a result, the drive of a pump includes different component, and different components are mounted on the pump housing or in its interior. This noticeably increases the production costs.

An object of the present invention is to provide a vacuum pump that would have an improved heat balance at reduced manufacturing and exploitation costs.

SUMMARY OF THE INVENTION

This and other objects of the present invention which will become apparent hereinafter, are achieved by providing a vacuum pump of the type described above and in which the housing has at least two housing sections, with the pumping system being located in one of the at least two housing sections and the control electronic being located in another of the at least two housing sections. Thereby, the functioning units, while being located in a single housing, are separated from each other, whereby, the components of a vacuum pump, which operate at different temperatures, are separated from each other. These measures also reduce costs as the sections can be used multiple times within a line of pumps and need not be adapted to each model of the pump line.

According to a further development of the present invention, the gas inlet and the gas outlet are located in a separate peripheral section. It is possible to form such a peripheral section for the entire pump line, which increases the costs advantages of the present invention. Simultaneously, the heat-conducting parts are located in their own section, which improves the heat balance of the pump.

Often, the vacuum pumps are equipped with electronics for diagnostic purposes and for purposes of remote communication, and a space is required for this electronics. According to the invention, this space is provided by a further intermediate section.

According to a still further development of the present invention, the fan is arranged in the intermediate section. Thereby, a cooling air flow can be produced independent from the pump motor and its rotational speed. This permits to achieve a drastically better cooling of the pump sections.

According to an advantageous embodiment of the present invention, a seal is provided between the control section that contains the control electronics, and an adjacent section. This seal forms a barrier for transmission of heat from one section to another section.

Advantageously, a seal is provided between the peripheral and intermediate sections.

The advantages of the invention are further increased when the sections are arranged axially one after another.

According to a further advantageous development of the present invention, the peripheral, intermediate, and the control sections are arranged in the vacuum pump housing one after another. Thereby, a thermal separation of the cold control section from the peripheral section is achieved. This protects the electronic components, which are located in the control section, from rapid deterioration.

The advantages of the present invention become particularly apparent in an oil-tight vane rotary vacuum pump in which the pumping system has a shaft extending eccentrically through a cylindrical bore formed in the housing, and a vane supported on the shaft for producing a pumping action. The pumping system is surrounded by lubricant that lubricates and seals the vane.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1A:
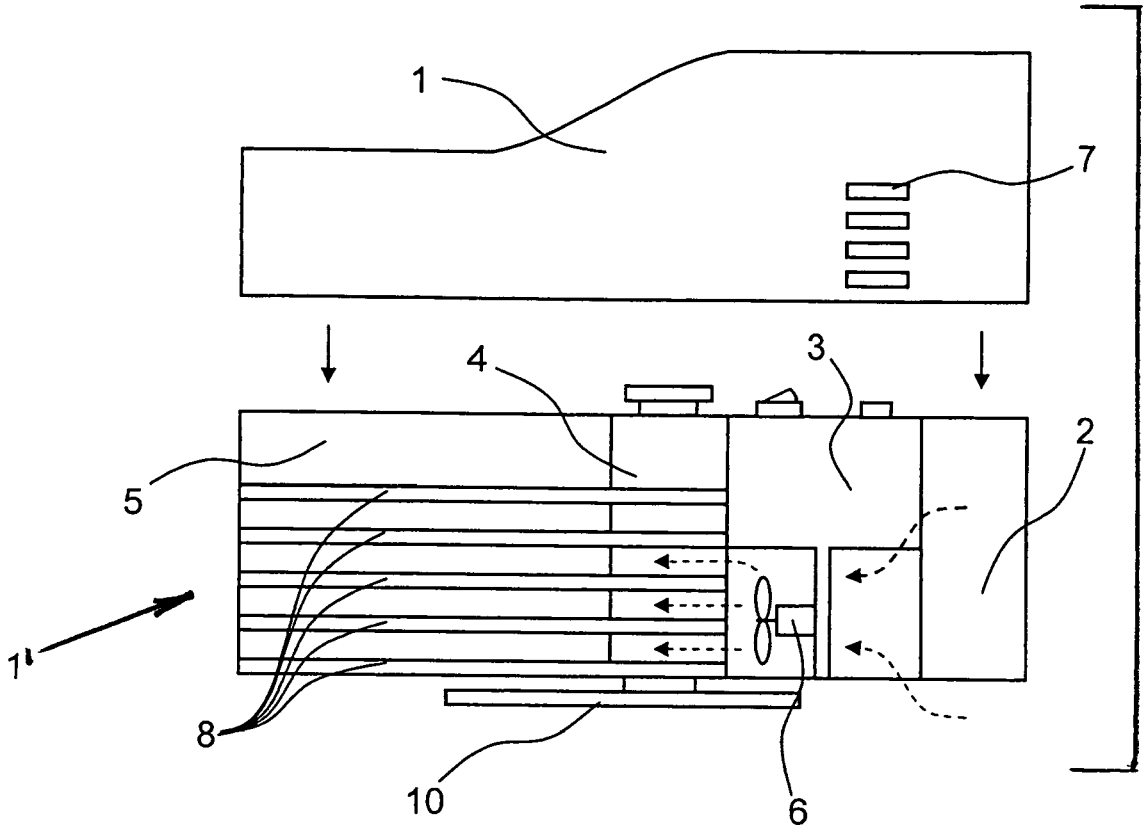
FIG. 1*a* a side view of a vacuum pump equipped with a hood according to the present invention in a disassembled condition.
Figure 1B:
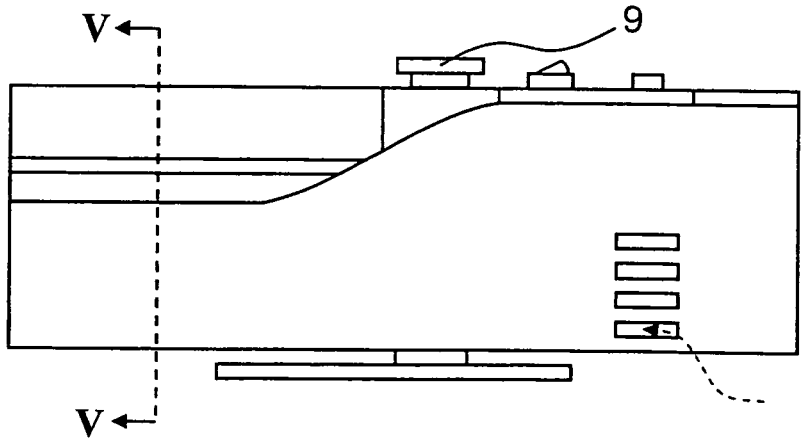
FIG. 1*b* a side view of the vacuum pump with a hood shown in FIG. 1*a* in an assembled condition.

FIG. 1 shows a vacuum pump that is formed of four sections and is surrounded by a hood 1. The hood 1 is shown in FIG. 1*a* in a disassembled or dismounted condition. In FIG. 1*b*, the hood 1 is shown in a mounted condition on the vacuum pump and surrounds a portion of the vacuum pump housing 1'. The vacuum pump itself rests on a stand 10.

The sections of the vacuum pump include different functional units. The control section 2 includes the control electronics that controls feeding of current from a network to the coils of the pump drive. In the intermediate section 3, a fan 6 is arranged. The fan 6 aspirates air and delivers it in the space between cooling ribs 8 provided on the housing, whereby cooling of the pump takes place. The suction and the delivery of air by the fan 6 is shown with the arrows. The peripheral section 4 includes gas connections, i.e., gas inlet 9 and gas outlet. The stand 10 also is arranged at the peripheral section 4. The stand 10 includes means, e.g., an elastomeric body which reduces transmission of vibrations between the vacuum pump and the floor. In the pumping section 5, those components of the pump are located with which the gas is compressed to such an extent that it can be discharged against the atmosphere. These four sections are arranged axially one after another, with the intermediate section being located between the peripheral and control sections. The pumping section 5 is provided on a side of the peripheral section 4 remote from the intermediate section 3. Thereby, a thermal separation of the cold control section from the peripheral section is effected. Thereby, electronic components within the control section are protected from a too rapid deterioration.

The sections of the vacuum pump are at least partially surrounded by the hood 1. In the embodiment shown in the drawings, the hood 1 is so formed that it covers the lower portion of the vacuum pump. Lower portion means a portion of the vacuum pump adjacent to the stand 10, i.e., in the direction of the floor. The shape of the hood 1 is such that the control and intermediate sections 2 and 3 are completely covered by the hood 1. The hood is somewhat short in the region of the pumping section, covering only the lower part of the pumping section. The cooling ribs 8 are provided in the lower part of the pumping section 5. However, the cooling ribs can also be formed in the upper part of the pumping section 5. The hood 1 covers at least a portion of the cooling ribs 8, forming channels that are limited by the hood 1, the pump housing, and the cooling ribs 8. For the purpose of protection, it can be sufficient to cover only the lower portion of the pump because it is in the lower portions of the pumping and peripheral sections 4 and 5 that the heat-carrying elements such as lubricant and coils are provided. When shaping a hood, design consideration can naturally play a certain role. The hood 1 also covers the fan 6.

In order for the fan to be able to aspirate the air and to deliver it into the channels, the hood has an opening. In the shown embodiment, the opening is formed as a plurality of aeration slots 7. The number and the shape of the slots 7 can vary for different pumps and are dependent on the requirements to the cooling gas flow.

Figure 2:
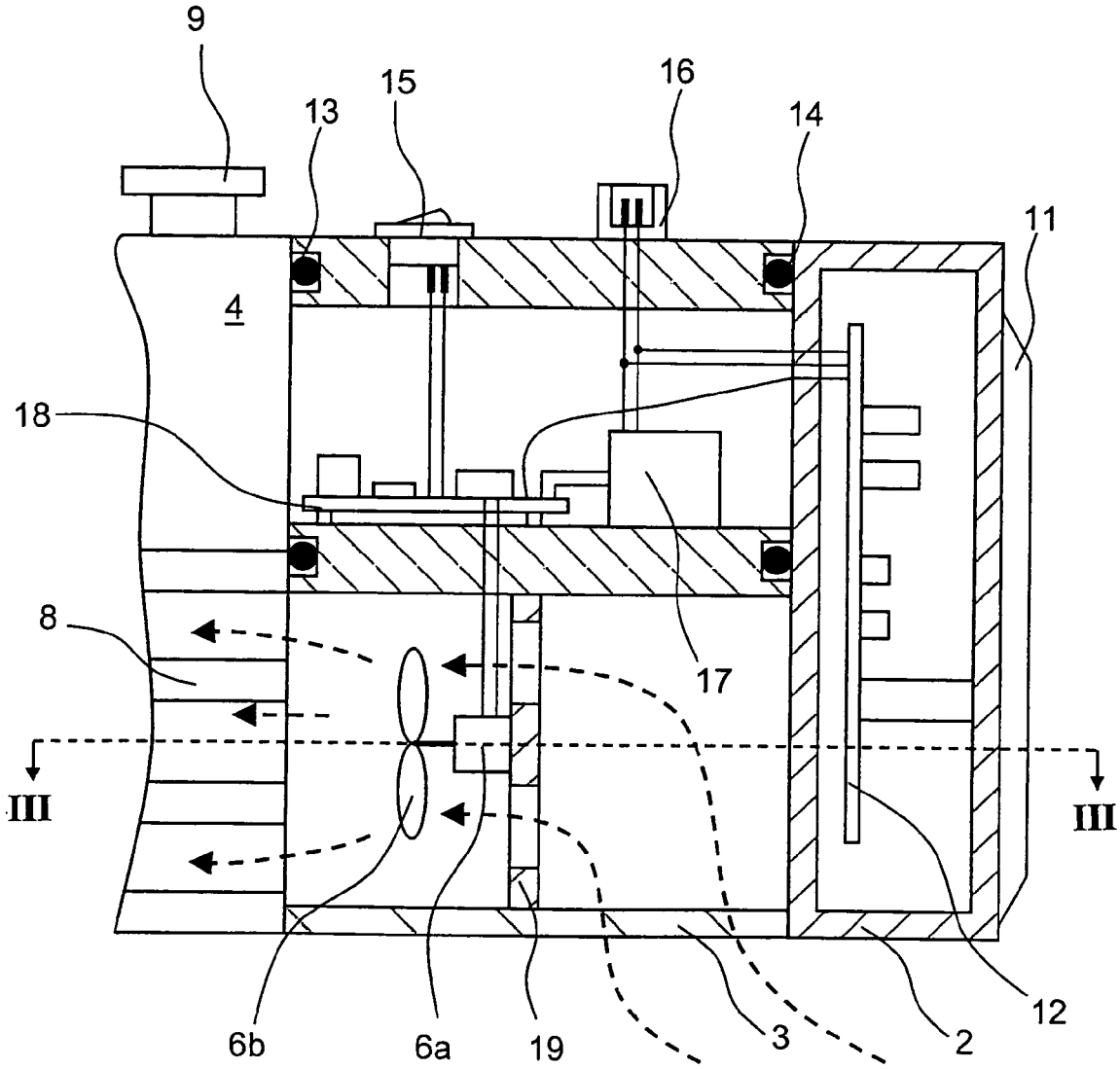
FIG. 2 a cross-sectional view through the intermediate section and the control section of the inventive vacuum pump.

FIG. 2 shows the design of the control and intermediate sections 2 and 3. The control section 2 has a closed housing with cooling ribs 11. The cooling ribs 11 insure cooling by a free convection. Within the control section 2, there are located electronic components which form control electronics and are mounted on a printed circuit board. The electronic components convert a supply voltage in such a way that feeding of voltage and current in a suitable form to the drive coils to provide for rotation of the drive shaft is insured. The supply voltage source can be a conventional network voltage of 220 V and 50 Hz or any contemporary industrial voltage such as 48V. Those components of the control electronics, which generate a certain amount of heat, can be so arranged that they would contact the inner wall of the housing of the control electronics. Advantageously, the contact takes place in the region of the cooling ribs 11. Likewise, it is possible to embed the control electronics in a filling compound partially or completely. This would also insure a high mechanical stability.

The intermediate section 3 contains several components in its housing. A switch 15 serves for turning the vacuum pump on and off. Further switches can be also arranged in the intermediate section housing. The further switches can include, e.g., a standby switch or a speed selection switch. Here, likewise, a socket 16, to which the power supply is connected, is arranged. This power is transmitted to the control electronics, on one hand, and on the other hand, it is transmitted to a small panel that is connected by suitable conductors with an auxiliary electronics 18, supplying it with power. The auxiliary electronics serves for converting the switching condition of the switch 15 in a control signal that is transmitted over suitable conductors to the control electronics. The auxiliary electronics has also means that insures feeding voltage to the fan motor 6*a* and that controls switching the fan motor 6*a* on and off.

According to further development of the present invention, further communication means can be arranged in the intermediate section 3, including the necessary switches, plugs, and bushings which are arranged on the housing wall similar to switch 15. These components are connected by electrical conductors or the like with the expanded auxiliary electronics that includes, e.g., means for controlling a field bus or serial interfaces and the like. These interfaces can be used for obtaining information from external control means and related to the operational state of the pump such as, e.g., "pump is operated," actual rotational speed of the pump, or active standby. The interfaces expand the vacuum pump capability for diagnose and remote communication.

A seal 14 provided between the housings of the intermediate section 3 and the control section 2. The seal 14 serves, on one hand, for sealing the inner space against the moisture and dust. On the other hand, the seal 14 functions as a thermal barrier, making the transmission of heat from the intermediate section to the control section more difficult. A similar seal 13 is also provided between the intermediate section 3 and the peripheral section 4, making the transmission of heat therebetween also more difficult. In a portion of the intermediate section 3, a support 19 supports the fan 6 that includes the motor 6*a* and a fan blade 6*b*. The dash arrows shown the cooling gas flow that is aspirated by the fan 6. The air is aspirated and flows between the cooling ribs 8.

Figure 3:
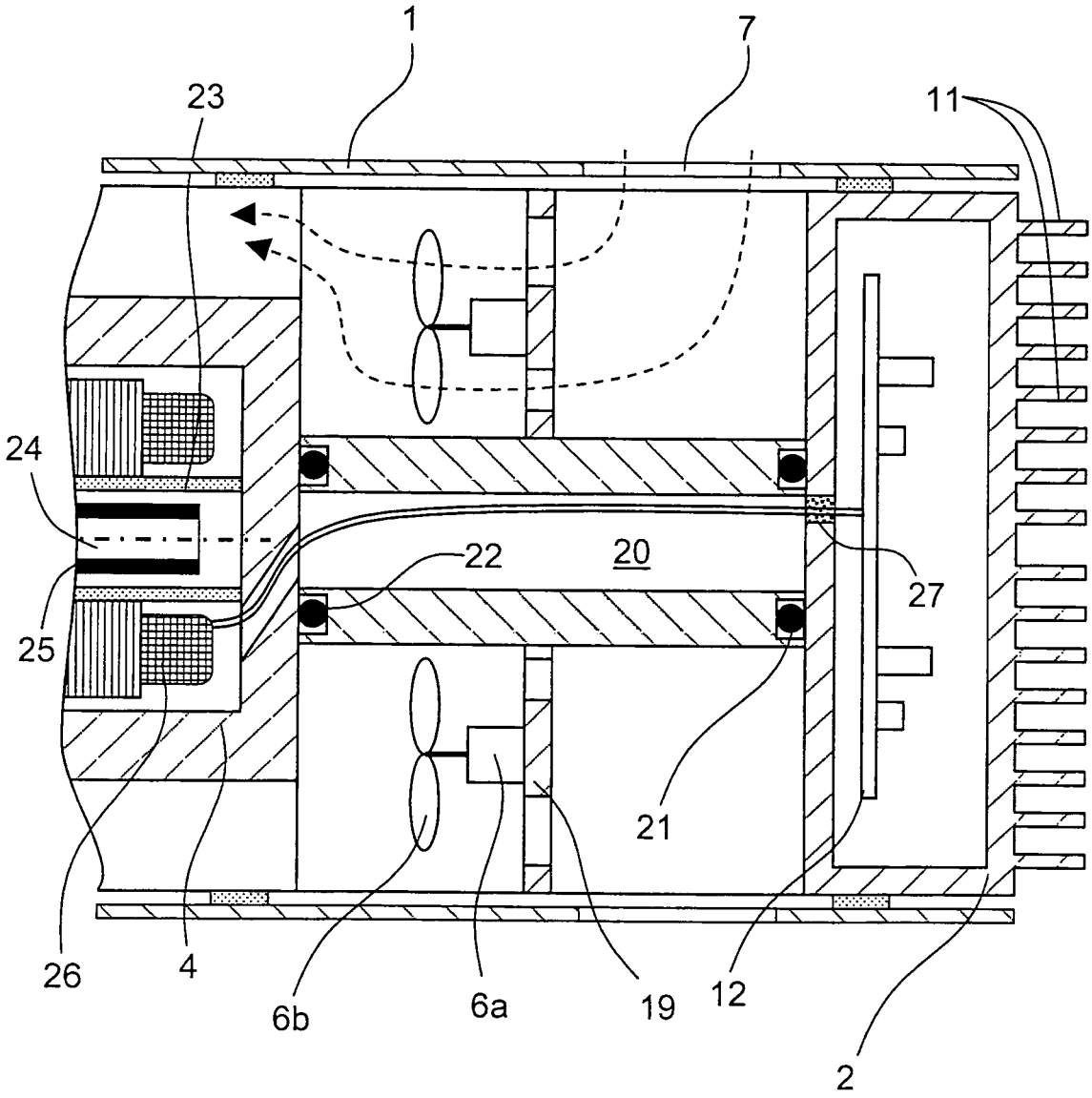
FIG. 3 a horizontal cross-sectional view along III-III in FIG. 2.

FIG. 3 shows a cross-sectional view of the control and intermediate sections 2 and 3 and a portion of the peripheral sections 4. In this view, cooling ribs 11, which are provided on a control section-side, end side of the vacuum pump, are shown in cross-section. The longitudinal axis of the ribs 11 is oriented in direction of the gravity force in order to optimize the free convection. Advantageously, the cooling ribs of the control section are not covered by the hood 1 in order not to obstruct the air flow of the free convection. The feeding electrical conductors from the control section 2 pass to the peripheral section 4 through a cable channel provided in the intermediate section 3. Two channel seals 21 and 22 protect the cable channel from moisture and dust. In particular, on a side of the motor control, a cable leadthrough 27 is provided. Inside the peripheral section 4, there are provided coils 26 of the pump drive.

The control electronics 12 provides for feeding power to the coils 26. A rotationally symmetrical separation member 23 is arranged between the coils 26 hermetically separating them from the inner space of the separation member 23. An end of a shaft 24, on which permanent magnets 25 are secured, projects into the inner space of the separation member 23. The cooling gas flow, which is generated by the fan 6, is again shown with dash arrows. The suction is effected through the aeration slots 7, and the air is delivered in the direction of the peripheral section 4. According to a further modification of the vacuum pump, such aeration slots are formed in the pump bottom. The stand then needs to be sufficiently spaced from the pump bottom in order to provide a clearance through which the air can be aspirated.

From FIG. 3, it should be clear that the present invention is not limited to the provision of a single fan. There can be provided a plurality of fans. In the discussed embodiment, two fans are provided in the lower portion of the intermediate section each of which feeds cooling air in the channel. The two fans are arranged on opposite sides of the vacuum pump, in particular, of the peripheral and pumping sections. Further fans can be provided for feeding cooling air to heat sources of the vacuum pump.

Figure 4:
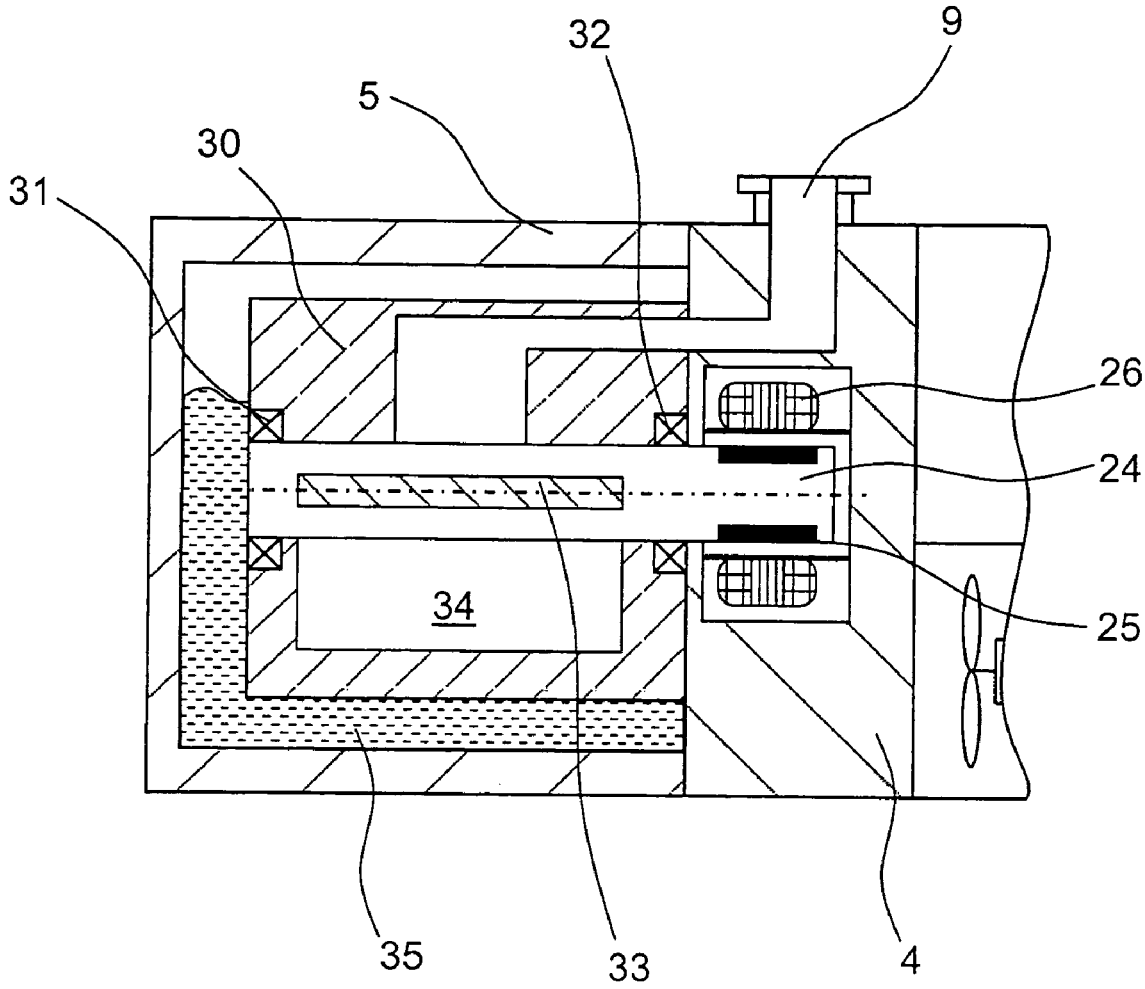
FIG. 4 a vertical cross-sectional view of through the pump-section and the peripheral section.

FIG. 4 shows a cross-sectional view of the peripheral and pumping section 4 and 5. The embodiment of the vacuum pump shown in the drawings represents a one-stage, lubricant-tight vane rotary vacuum pump. The vacuum pump shown in FIG. 4 has a pumping system 30 located in the pumping section 5. The pumping system 30 has its end side connected with the peripheral section 4 along a large surface, whereby a good heat transmission is insured. The housing of the pumping section 5 has good heat-conducting characteristics, so that the heat of the peripheral section 4 is transmitted to a large-surface body. The shaft 24 eccentrically extends through a cylindrical bore formed in the pumping section 5. The shaft 24 can be formed of one or several pieces and is rotatably supported by first and second slide bearings 31 and 32 which are lubricated by a lubricant. The lubricant is supplied from a lubricant reservoir 35 that surrounds the pumping system 30. The lubricant, primarily oil, in addition to lubricating the bearing 31, 32, also lubricates vanes 33. The vanes 33 are rotatably supported in the cylindrical bore of the pumping section 5, with a compression chamber 34 being formed between the wall of the cylindrical bore and the vanes 33. The gas flows into the compression chamber 34 via the gas inlet 9. The permanent magnets 25 are secured, as it has already been discussed above, on the end of the shaft 24 that projects into the peripheral section 4 in which the coils 26 are located. Cooperation of the magnets 25 with coils 26 provides for rotation of the shaft 24, with the coils 26 and permanent magnets 26 forming an electric motor. Here, there is provided a brushless D.C. motor. The advantages of the present invention are particularly apparent with this type of an electric motor, as the control section can be simultaneously used for the entire line of the housing sections. However, the invention can also be used with housing sections based on different pumping principles. Thereby, manufacturing costs can be reduced. The invention is not limited to the drive motor above.

Figure 5:
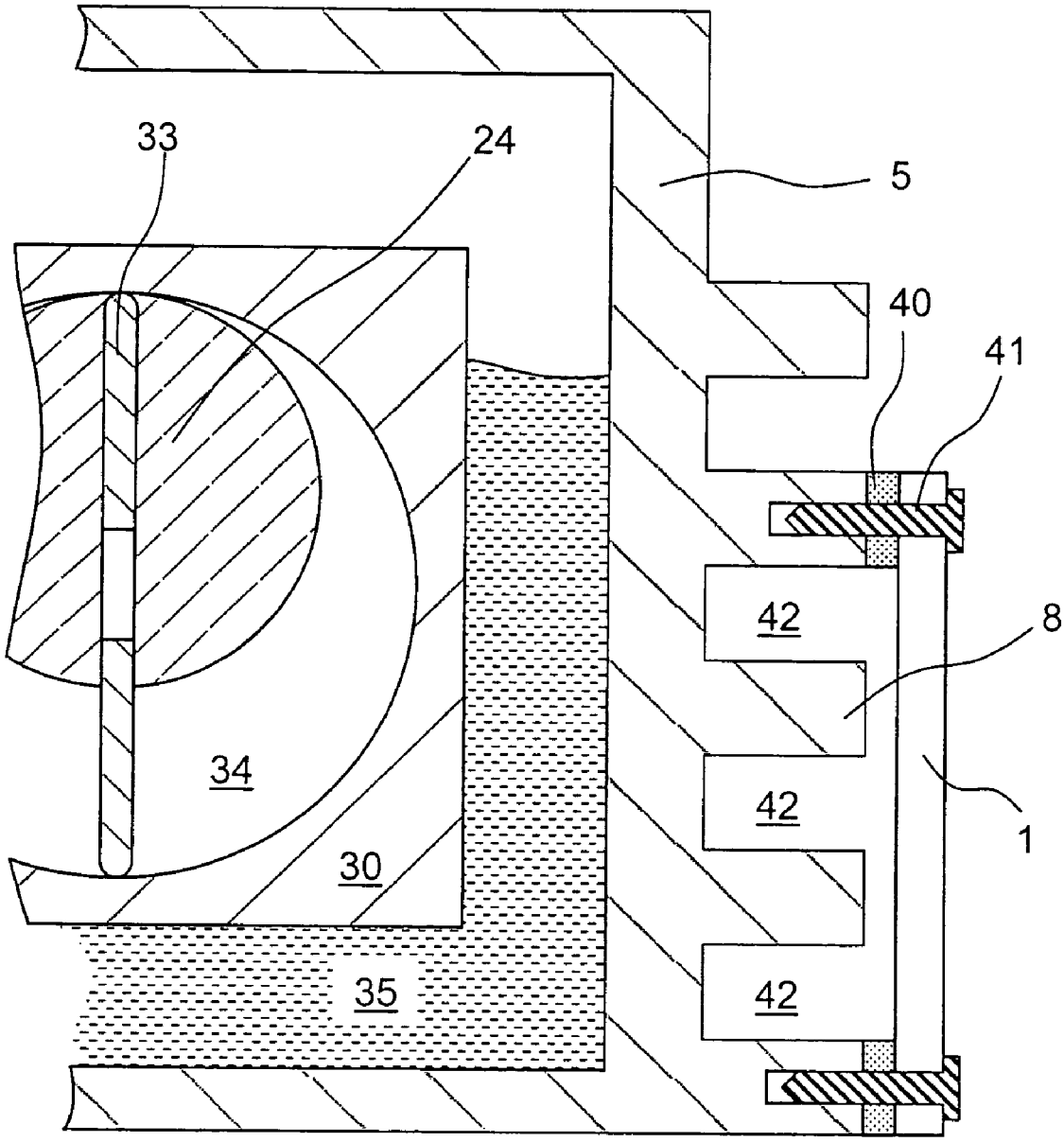
FIG. 5 a cross-sectional view along line V-V in FIG. 1.

FIG. 5 shows a vertical cross-sectional view of the pumping section 5. FIG. 5 illustrates in particular the eccentric position of the shaft 24 and the position of vanes 33. Between the vanes 33 and the shaft 24, there is provided a spring, not shown. The pumping section housing has the cooling ribs 8. The hood 1 covers the cooling ribs 8, forming flow channels 42. The cooling gas flow, which is generated by the fan 6, flows through the flow channels 42, which can be connected with each other, absorbs the heat of the housing and carries the heat away from the housing. The heat is produced in the pumping system 30 and is transmitted to the housing by the lubricant reservoir 36.

Preferably, the hood 1 is so shaped that the channels are open at their ends. This can be managed very easily as the hood 1 does not cover the pumping section-side, end side of the inventive vacuum pump. Between the hood 1 and the housing, there is provided an intermediate element 40 that, e.g., has highly elastomeric components. The intermediate element 40 serves as a thermal barrier and also for reduction of transmission of vibrations from the pump housing to the hood 1. The hood 1 is fixed with attachment means, e.g., with screws 41.

The embodiment of the vacuum pump shown in the drawings has a favorable heat balance. A first source of an extensive heat is the heat of compression in the pumping section 5. A further source of an extensive heat is the peripheral section 4 because it is there that the drive coils, in which the power dissipation is converted into heat, are located. In addition, the heat to the peripheral section 4 is transmitted by the end side of the pumping system 30 which contact the peripheral section 4 along a large surface. These heat sources are isolated from the control section by the intermediate section. In view of the serial connection of the pump sections, this distance is maximized. Also, the thermal resistance of the seals, which are provided between the intermediate section and the adjacent sections, contributes to isolation of the heat sources from the control section 2. These passive measures provide for a very favorable heat balance. The active cooling with a fan also contributes to the favorable heat balance. By locating the fan in the intermediate section, the sections, which generate most of the heat, are subjected to the action of the cooling air. The hood serves, on one hand, as a convection protector and, on the other hand, guides the cooling air flow, which is generated by the fan, in optimal manner to the heat sources of the pumping and peripheral sections. In those regions, where no air movement takes place, under the hood, the air acts as an air cushion and isolates the environmental heat from the bottom parts, e.g., of the control section. In sum, the cooling of the inventive vacuum pump is noticeably improved in comparison with the state of the art.

The embodiment shown in the drawings represents an oil-tight vane rotary vacuum pump. However, the present invention can be adapted to other vacuum pumps for producing low and high vacuum by replacing the pumping section. In the replaced pumping section other pumping principles can be used. Examples of the applicable principles can be found in, e.g., dry piston compressor, dry vane rotary or rotary piston pump.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A vacuum pump for producing one of low vacuum and high vacuum, comprising:

a housing having a gas inlet and a gas outlet;

a pumping system located in the housing;

a motor for driving the pumping system;

control electronics for controlling operation of the vacuum pump;

said housing having four separate housing sections arranged side by side along a shared axis, wherein the separate housing sections do not axially overlap;

said separate housing sections including: a pumping section in which the pumping system is located, a control section in which the control electronics are located, a peripheral section located adjacent to the pumping section and in which the gas inlet and the gas outlet are located, and an intermediate section located between the control section and the peripheral section in which a fan is located;

a first seal located between adjoining sides of the peripheral section and the intermediate section, and a second seal located between adjoining sides of the intermediate section and the control section, wherein the first and second seals provide thermal barriers between the separate housing sections.

2. A vacuum pump according to claim 1, wherein the pumping system comprises a shaft extending eccentrically through a cylindrical bore formed in the housing and vanes supported on the shaft for producing a pumping action, the pumping system comprising lubricant for lubricating and sealing the vanes.

3. A vacuum pump according to claim 2, further comprising at least one bearing for supporting the shaft and lubricated by the lubricant of the pumping system.

4. A vacuum pump according to claim 2, comprising a reservoir located in the pumping section surrounding the pumping system and in which the pumping system lubricant is stored.

5. A vacuum pump according to claim 1, further comprising a removable hood at least partially surrounding the housing and covering at least one of the four separate housing sections.

6. A vacuum pump according to claim 5, wherein the hood surrounds the intermediate section and has at least one opening for enabling aspiration of air by the fan.

7. A vacuum pump according to claim 1, wherein drive coils of the motor are located in the peripheral section.

8. A vacuum pump according to claim 1, wherein the fan has its own motor functioning independently from the pump system motor.

* * * * *